United States Patent [19]

Pfeffer

[11] 4,294,655

[45] Oct. 13, 1981

[54] METHOD AND APPARATUS FOR FORMING FIBERGLASS MATS

[75] Inventor: John R. Pfeffer, Bakersfield, Calif.

[73] Assignee: Consolidated Fiberglass Products Company, Bakersfield, Calif.

[21] Appl. No.: 97,776

[22] Filed: Nov. 27, 1979

Related U.S. Application Data

[63] Continuation of Ser. No. 886,881, Mar. 15, 1978, abandoned.

[51] Int. Cl.[3] ..... D21H 3/82

[52] U.S. Cl. ..... 162/107; 162/108; 162/156; 162/184; 162/299; 162/322; 162/350

[58] Field of Search ..... 162/107, 108, 145, 156, 162/184, 207, 212, 217, 265, 290, 299, 322, 350, 351; 428/293, 294; 65/4 R

[56] References Cited

U.S. PATENT DOCUMENTS

| | | | |
|---|---|---|---|
| 2,653,090 | 9/1953 | Crandall | 162/107 |
| 2,699,389 | 1/1955 | Crandall | 162/107 |
| 2,731,066 | 1/1956 | Hogendobler et al. | 428/293 |
| 2,875,503 | 3/1959 | Frickert et al. | 65/4 R X |
| 3,293,116 | 12/1966 | Operbeck et al. | 162/156 X |
| 3,758,375 | 9/1973 | Keib et al. | 162/156 |
| 3,892,622 | 7/1975 | Skaugen | 162/108 |
| 3,905,067 | 9/1975 | Keib et al. | 162/322 |

FOREIGN PATENT DOCUMENTS

| | | | |
|---|---|---|---|
| 1376130 | 12/1974 | United Kingdom | 162/156 |

*Primary Examiner*—Robert L. Lindsay, Jr.
*Attorney, Agent, or Firm*—Whann & McManigal

[57] ABSTRACT

A machine and method of forming fiberglass mats. Chopped glass fibers are mixed with water in a slurry and a movable screen is passed, generally upwardly, through a slurry. As the screen is moved, its surface is uniformly coated with the glass fibers in a uniformly increasing depth, dependent upon the length of travel of the screen through the slurry. Longitudinally oriented and randomly oriented continuous strands are projected onto the fibers captured on the screen at different locations in order to provide the resultant mat with tear strength in all directions. The screen passes over a vacuum for removal of most of the water from the workpiece; subsequently, a binder is added to the workpiece and the continuous mat is passed through an oven for curing of the binder. The mat is then wound upon a spool for later transport to a location in which the mat can be processed into a final product.

14 Claims, 11 Drawing Figures

METHOD AND APPARATUS FOR FORMING FIBERGLASS MATS

This is a continuation of application Ser. No. 886,881, filed Mar. 15, 1978, now abandoned.

BACKGROUND OF THE INVENTION

A wide variety of products today are produced from fiberglass mats. For example, many modern roofing materials are made from fiberglass mat. This includes both the roll material which are used in place of the asphalt-impregnated felt materials employed in the plys of flat roofs, as well as in the smaller shingles often found on residential roofs.

In the past, fiberglass mats which could be converted into these roofing materials were normally produced in a dry process. They comprised a combination of chopped glass fibers in a cured binder material which, preferably, was water resistant. In such dry processes, the chopped fibers were usually distributed over a formation surface by some available means, such as air pressure which would blow the fibers around until they landed on the surface. Unfortunately, it has been found that the fibers do not distribute properly in these dry processes, leaving portions of the resultant product dangerously weak. More importantly, mats formed in this manner have little or no ability to resist tearing when a force in any direction is applied to the mat.

In order to overcome these difficulties, it has been proposed at various times to install continuous slivers or strands of fiberglass in the mats prior to application of the binder. Such a process has been shown, for example, in U.S. Pat. No. 2,731,066 to Hogendobler, et al.

Unfortunately, the mats produced by such processes have been deficient due to inherent mechanical weaknesses. For example, there still exists a distribution problem with respect to the chopped glass fibers. Further, since such processes do not try to locate the continuous strands on a single cross-sectional plane, such mats still have insufficient tear strength. The indiscriminate vertical dispersion of the strands within the mats decrease their mechanical strength and often results in the final product separating into longitudinal strips or laminae.

Further, it has been found that the dry process for production of fiberglass matting is much too slow to meet the production requirements generated by the need for roofing materials in construction and repair, as well as by other products utilizing such mats.

Recently, a wet process for producing fiberglass matting has been developed in some foreign countries. This process is superior to the dry process in that the rate of production is much greater and the chopped glass fibers are relatively uniformly distributed throughout the mass. However, such processes have not been able to employ the reinforcing strands discussed previously with respect to the dry process as shown in the Hogendobler, et al. patent.

Consequently, while such wet process matting can be produced at a more rapid pace with a more uniform distribution of the glass fibers, it has been unable to resist tearing when a force is applied to the matting in almost any direction. This is not totally unsatisfactory in the foreign countries concerned, since construction there is accomplished at a much more leisurely pace and the material can be more carefully handled. In the United States, on the other hand, such materials have failed to withstand the rough handling generated by the speed with which such products must be handled and applied in construction.

Consequently, a very pressing need for a uniform, high-production speed, relatively strong fiberglass matting has developed and that need has, heretofore, not been satisfied by the industry.

SUMMARY OF THE INVENTION

The present invention relates to a method and apparatus for producing such fiberglass matting. More particularly, the present invention involves a wet process mat-production in which continuous reinforcing strands are applied to the mat during production to provide tear resistance against forces applied in any direction.

In the preferred embodiment of the invention, chopped glass fibers are mixed with water into a slurry which is contained in a tank or bath. Such fibers may range in length, for example, from $\frac{1}{4}''$ to $1\frac{1}{4}''$ and in diameter from 9 to 16 microns. A screen may be moved through the tank from a position near the bottom toward the top in such a manner that fibers are captured on the screen in a thickness which increases as the screen moves upwardly from the bottom toward the top of the tank. The thickness of the resulting mat is dependent upon the distance the screen must travel through the slurry, the density or solid concentration of the slurry and the time (speed) that the screen is exposed to the slurry.

In order to provide the mat with tear strength in a lateral direction, i.e., perpendicular to the long dimension of the mat being formed, distinct layers of continuous strands or slivers of fiberglass can be laid into the mat. In order to produce the greatest strength while preventing delamination of the mat, the longitudinally oriented layers of strands may each be located on a single longitudinal or horizontal plane, considering a vertical cross-section of the mat, i.e., perpendicular to the top and bottom mat surfaces. The layers may be separated by fiber-binder material of predetermined thickness.

The continuous strands may each be laid on the screen by a projecting or propelling unit which draws the strand from a spool and uses the pressure of water or other fluid to pull the strand from the spool and project it onto the screen.

In some instances, the fluid projection pressure may be adjusted so that the strands form substantially straight lines in the mat. At other times, it may be preferred that sufficient pressure be employed to cause the strands to form sinusoidal configurations extending in a generally longitudinal direction in the mat. The advantages of these strand configurations have been taught, for example, in my copending Application, Ser. No. 868,725, filed Jan. 11, 1978. It is noted that that application discloses a mat which may be formed by means of the method and apparatus taught in this invention.

Also, in order to provide such a mat with strength to resist tearing in the longitudinal direction. It has been found to be desirable to lay randomly oriented strands of yarns into the mat, again on a distinct horizontal plane in the mat. Preferably, the horizontal planes of the randomly oriented strands and the longitudinally oriented strands may be separated by chopped glass fibers, thereby preventing the formation of a planar surface-to-surface junction along which lamination may occur.

Preferably, the randomly oriented strands and the longitudinally oriented strands are projected toward the moving screens at distinct locations within the slurry bath. Consequently, the travel of the screen between those two locations will result in the capturing of additional chopped fibers between the horizontal planes of the two types of strands. Thus, the resultant product will have increased mechanical strength to resist delamination, as well as having improved tear strength. Also, since the mat is formed by movement of the screen through the slurry tank, the speed of mat production is controlled only by the ability of the screen to pick up the chopped fibers. Consequently, the speed with which the continuous strands can be projected onto the screen can be adjusted accordingly to produce the desired results.

After the screen moves out of the slurry tank, it may be passed over a vacuum which will draw most of the water out of the fiber-strand workpiece, allowing a degree of cohesiveness not possible in a slurry material. Subsequently, any suitable bonding agent, such as urea resins, phenolic resins, bone glue, polyvinyl alcohols, etc., can be applied to the workpiece. The new combination of materials can then be passed through an oven or, in some other manner, cured and gathered on a spool. Preferably, and depending primarily upon the ultimate product application of the mat, the binder should be water resistant.

Those skilled in the art, upon review of the following detailed description, taken in company with the drawings, will realize a number of additional objects of the present invention. They will also realize that apparatus formed in accordance with the present invention allowing use of the method may be embodied in a wide variety of structures, many of which may not even resemble that described and disclosed here.

DETAILED DESCRIPTION

Figure 1:
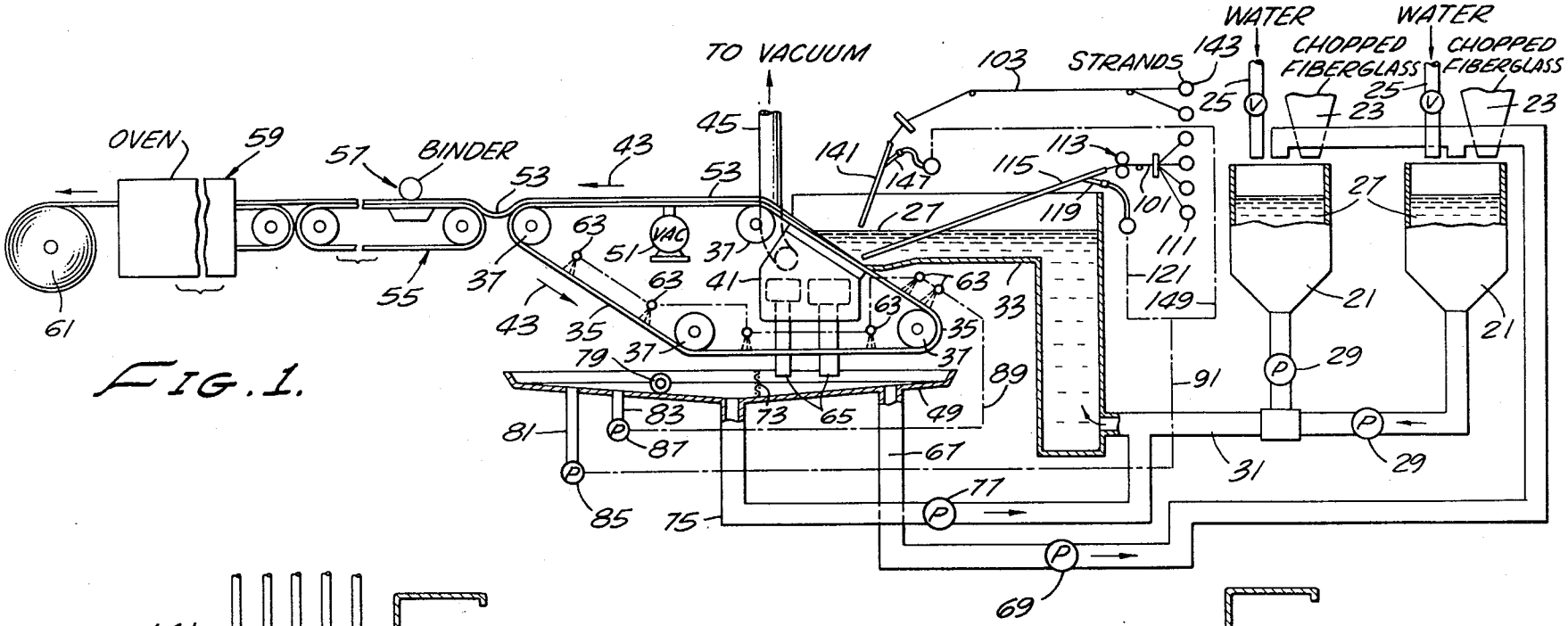
FIG. 1 comprises a schematic illustration of a machine which may be employed in accordance with the present invention.
Figure 4:
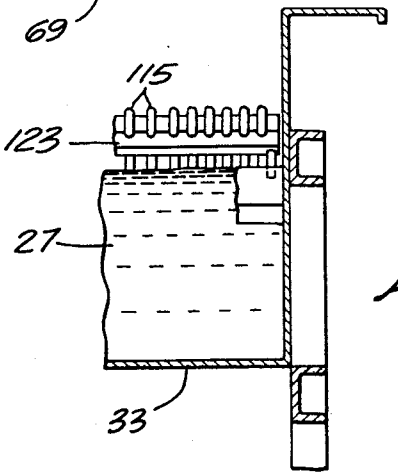
FIGS. 4 and 5 comprise partial sectional views of the structure shown in FIG. 2, as seen along the lines 4—4 and 5—5, respectively.
Figure 5:
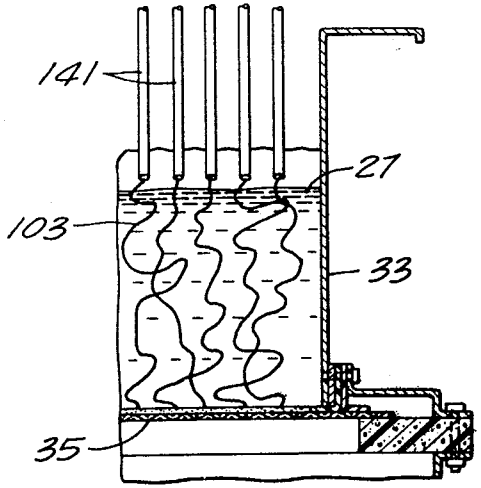

As shown in FIG. 1, one or more tanks 21 may be provided for mixing chopped glass fibers, which may be fed into the tanks through funnels 23, with water delivered through pipes 25 to form a slurry 27. Two or more tanks may be employed so that fresh water may be injected into one of the tanks through the pipe 25 for mixture of a new slurry. At the same time, water removed from the slurry later in the process may be returned to the other tank for continuation of the process as the slurry is drawn from that other tank. In any event, a selected one of the tanks may be evacuated by a pump 29 in order to feed the slurry through a pipe 31 to a slurry tank or bath 33. The slurry tank may be constructed in a leak-proof fashion so that a mat building screen 35, mounted on rollers 37, may pass through the tank and be gradually elevated in the tank. One or more of the rollers 37 may, if desired, be provided with a drive system including a motor 117 (FIG. 2) in order to insure continuous movement of the screen 35.

In this preferred embodiment, a vacuum chamber 41 may be located on the opposite side of the screen from the slurry tank 33 so as to draw the slurry toward the screen. Thus, as the screen 35 passes upwardly through the tank 33, it will continuously pick up fibers in uniform distribution across the surface of the screen. The thickness of the fiber build-up will be directly dependent upon the following:

1. The distance the screen must travel through the slurry,
2. The "density" or solid concentration of the slurry,
3. The time (speed) that the screen is exposed to the slurry In other words, considering the screen in its movement in the direction of the arrows 43 the fiber build-up will continuously thicken as the screen travels from the bottom to the top of the tank. This can be seen, for example, by a careful review of FIGS. 1 and 2.

In any event, a negative atmospheric pressure may be generated in the chamber 41 by any suitable vacuum means (not shown) acting through a conduit 45. Any liquids, fibers, etc., passing through the screen and entering the chamber 41 may be delivered to a catch-basin 49 located, preferably, below the entirety of the screen.

As the screen leaves the slurry tank 33, it may be passed over a vacuum 51 which will draw most of the slurry water remaining mixed in the fibers out of the wet mat workpiece. The workpiece may then be transferred to any suitable conveyor system 55 and moved past a binder application station 57. Although any suitable binding agent may be applied at the binder station 57, it is presently preferred that such a binding agent be water resistant or water-proof since such an agent would be suitable for substantially any application to which the mat 53 might later be adapted. The mat may then be passed through an oven 59 in which the binder may be cured; any water remaining in the mat 53 will thus be eliminated by evaporation. The mat may then be gathered onto a spool 61 for later transportation and use in a final product preparation.

As can be seen in FIG. 1, water may be used to wash the screen 35, after the mat 53 is separated therefrom, by moving the screenpast a plurality of spray pipes 63. The water may be taken from the drain pan 49 located below the screen in a manner to be described. Also, the slurry water sucked through the screen and into the vacuum chamber 41 may also be delivered to the pan 49 by one or more suitable exhaust pipes 65 as illustrated. Since the water passing through the pipes 65 will be heavily laden with chopped glass fibers, this high concentrate slurry may be passed through a pipe 67 by means of a pump 69, for delivery to one of the tanks 21 as illustrated. On the other hand, some of the water at the right end of the drain pan 49, as seen in FIG. 1, may pass through a screen 73 and then pass through a pipe 75. By means of a pump 77 the fluid in pipe 75 may be delivered directly back to the pipe 31 for movement to the slurry tank 33.

As the water in the drain pan 49 continues to move from right to left, as seen in FIG. 1, it may be passed through a rotating fiber screen-water blaster device 79 of any suitable type. As a result, the water at the left end of the drain pan 49 will normally be the most free of the chopped fiber particles. This fluid can be withdrawn from the pan 49 through pipes 81 and 83 by pumps 85 and 87, respectively. Water withdrawn by pump 85 may be passed through a conduit 89 for transmittal to the screen wash spray pipes 63, as illustrated. On the other hand, water pulled out of the pan 49 by pump 87 may be passed through a pipe 91 for a purpose to be described.

Figure 2:
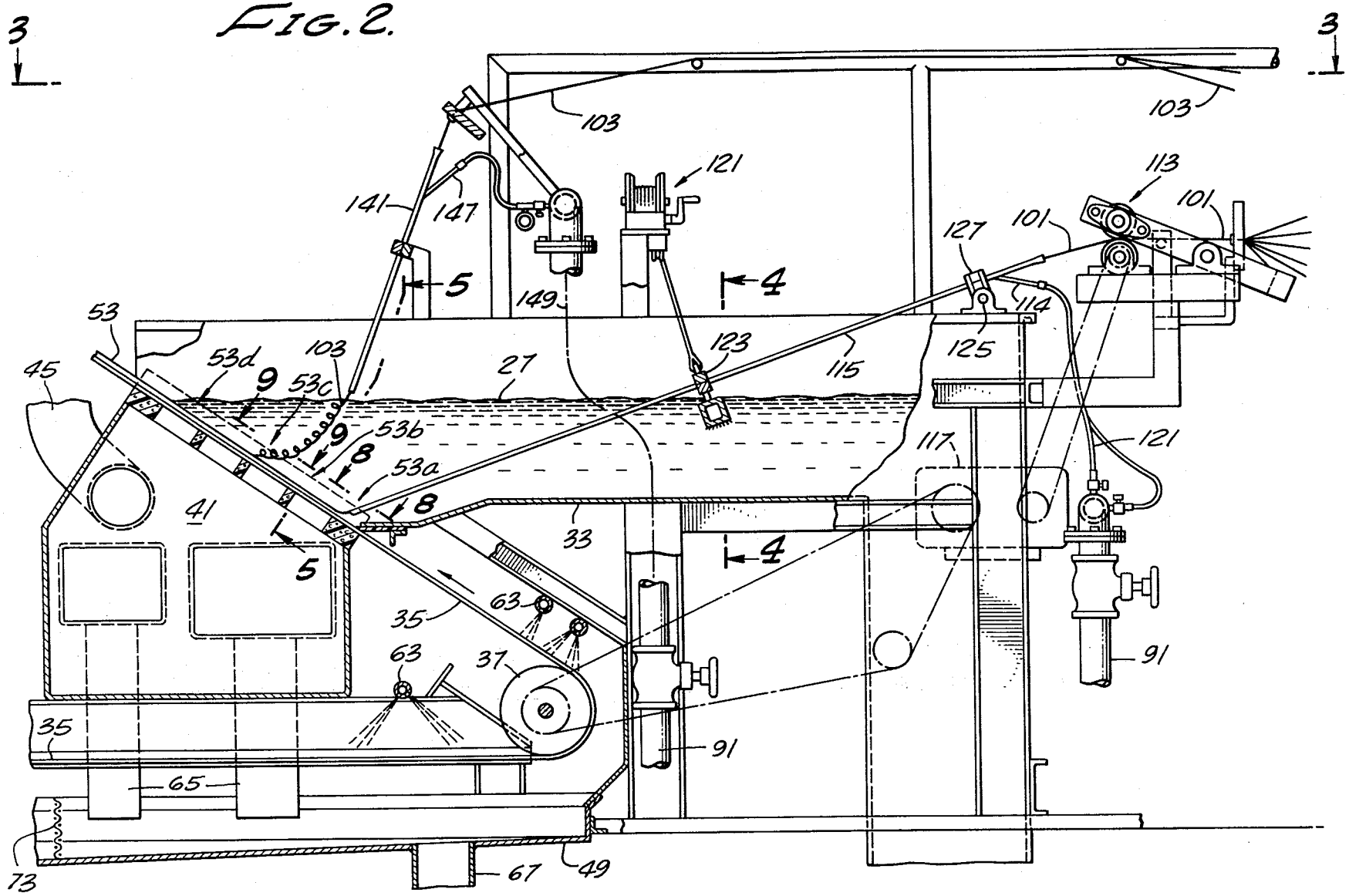
FIG. 2 comprises an enlarged view of a portion of the machine shown in FIG. 1, illutrating the structural relationships of a preferred embodiment of the invention.
Figure 3:
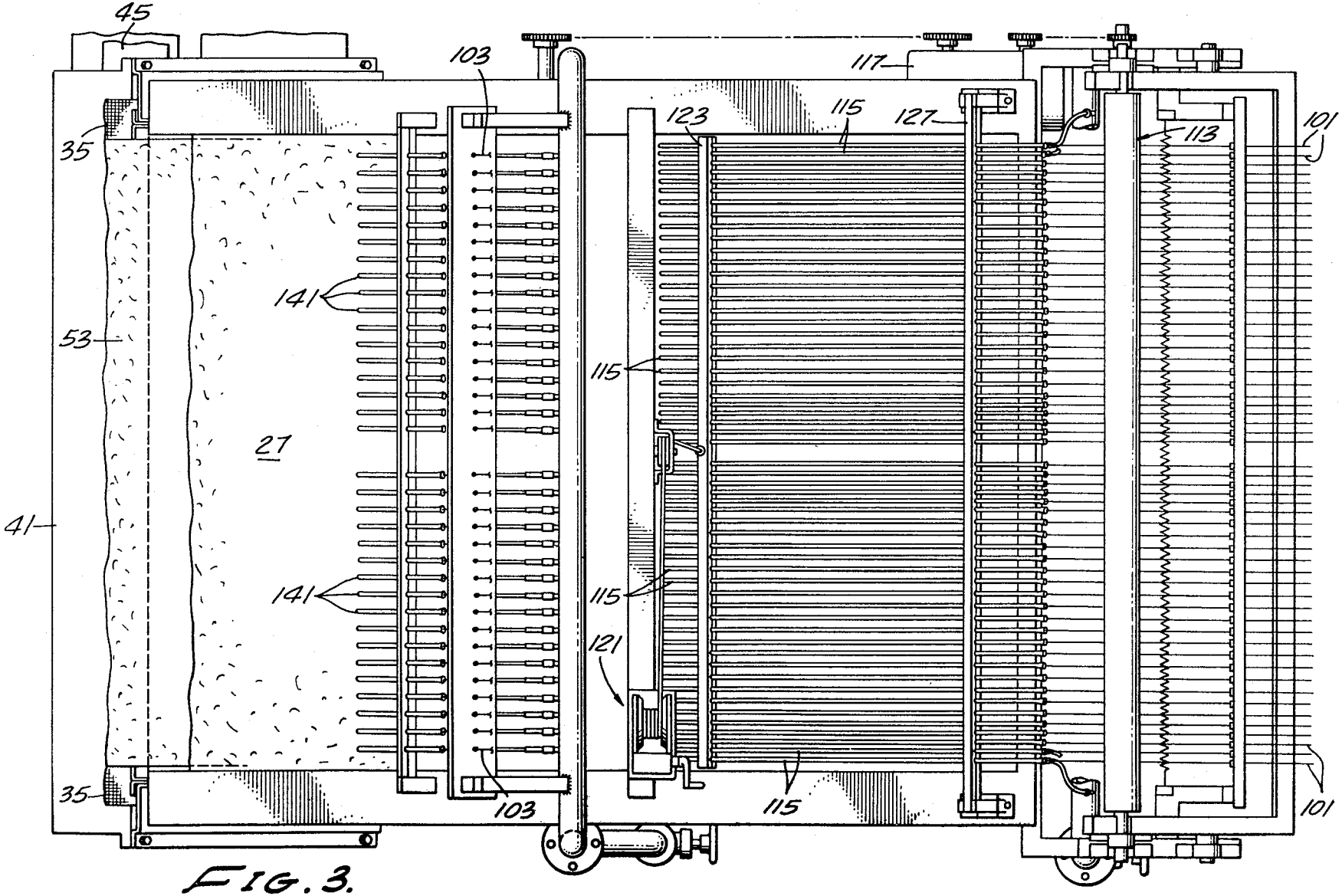
FIG. 3 comprises a top plane view of the structure shown in FIG. 2, as seen along the line 3—3 therein.
Figure 6:
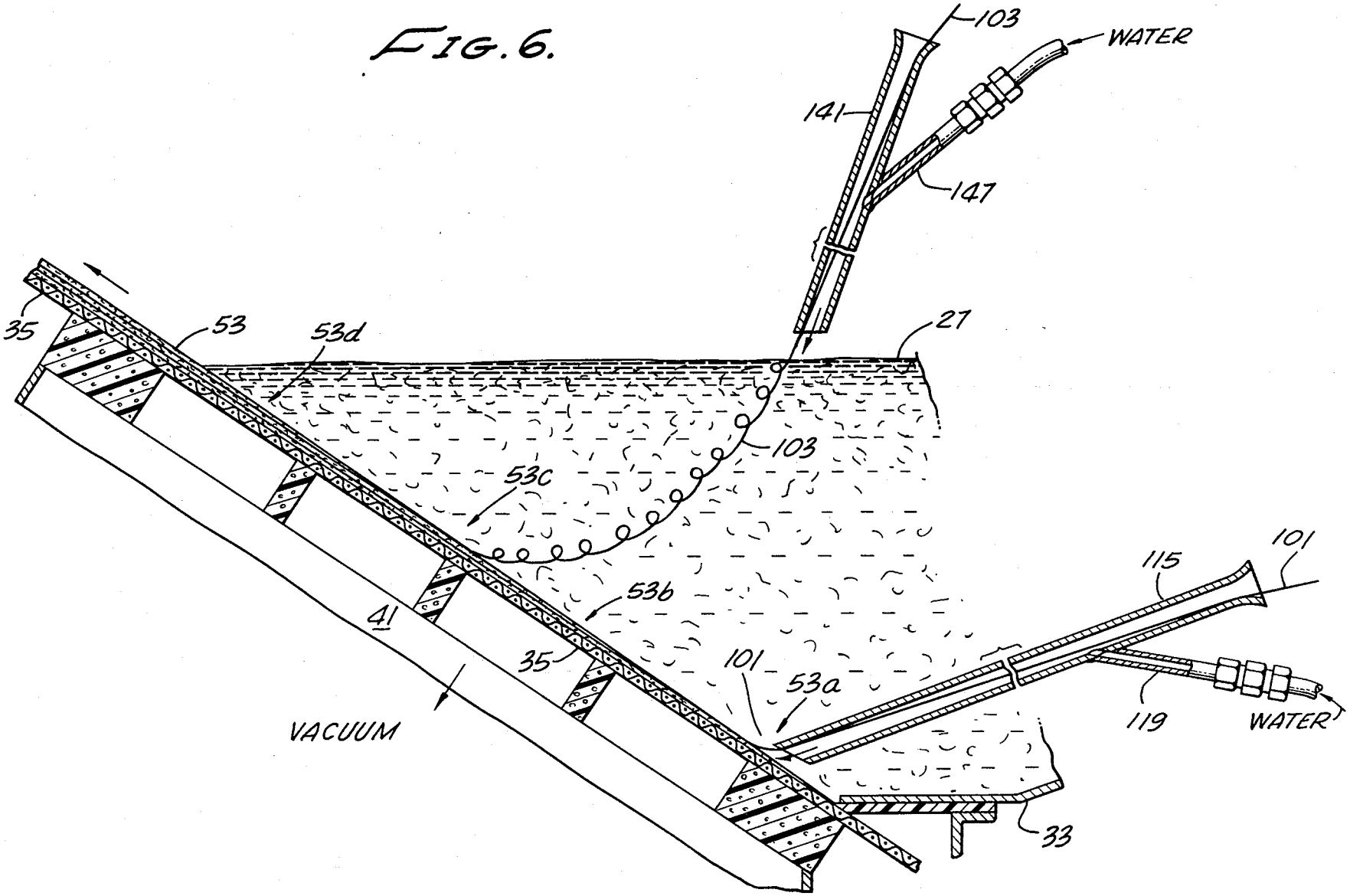
FIG. 6 comprises a further enlarged side sectional view of a portion of the structure shown in FIG. 2.
Figure 8:
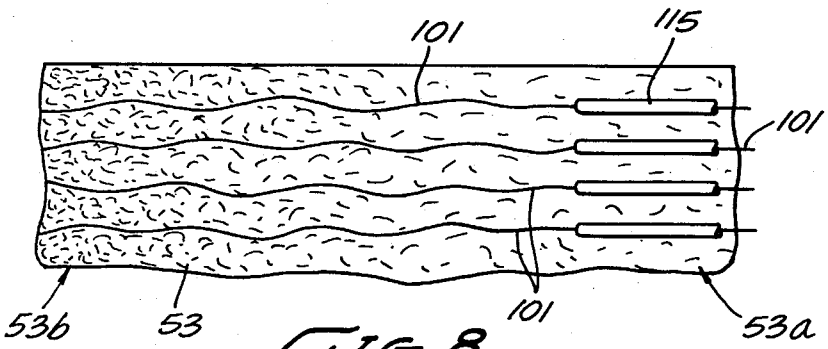
FIG. 8 comprises a plan view of the mat as seen along the line 8—8 in FIG. 2.
Figure 9:
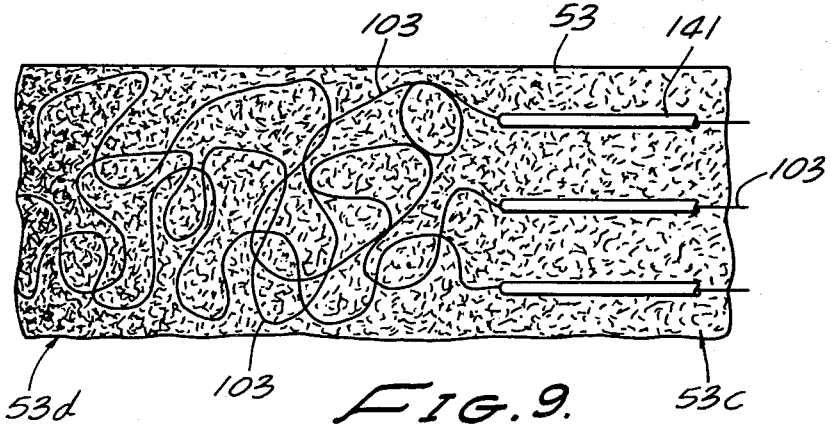
FIG. 9 comprises a plan view of the mat as seen along the line 9—9 of FIG. 2.

Referring now to FIGS. 8–11, there is shown a mat material 53 comprising a plurality of chopped fibers which becomes thicker as the screen 35 moves from right to left in FIGS. 1 and 2. Consequently, at locations 53*a* (FIGS. 2 and 8) the fibers may be considered to be just beginning to gather, somewhat thicker in depth at 53*b* (FIGS. 2 and 8), still thicker at 53*c* (FIGS. 2 and 9), and relatively very thick at 53*d* (FIGS. 2 and 9).

As shown in FIG. 8, transverse tear strength may be provided in the mat 53 by providing a plurality of strands 101 which may be generally longitudinally oriented in the direction of mat movement, as illustrated. In some instances, the strands 101 may be substantially straight within the mat.

Preferably, however, in most applications it is preferred that the strands 101 have a generally sinusoidal configuration. Such a configuration allows a mat production crew to locate imperfections in the workpiece if any one of the strands 101 should "hang up" while being pulled from the spool. As explained in my copending application, Ser. No. 868,725, such a "hang up", or "fishlining", tends to disrupt the fibers in the mat 53 and may often result in a severely damaging point of weakness in the mat.

Figure 11:
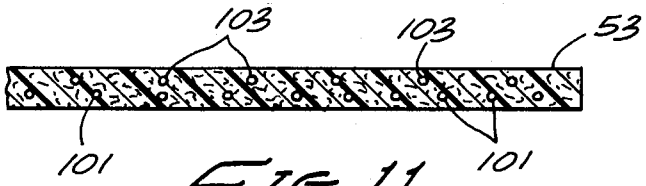
FIG. 11 comprises a vertical cross-section of a mat formed in accordance with the present invention, as seen along a line 11—11 of FIG. 10.

In order to provide longitudinal tear resistance, a plurality of randomly oriented continuous strands 103 may be laid into the matting as illustrated in FIG. 9. Preferably, the strands 101 should be on a single horizontal plane, considering the mat in vertical cross-section, as shown in FIG. 11. Similarly, the strands 103 should be on a separate and distinct horizontal plane as illustrated. In other words, it is preferred that a build-up of chopped fibers and binder be located between the planes of the strands 101 and 103 in order to provide mechanical strength in the mat 53 and prevent possible lamination of the mat. Thus, considering FIGS. 10 and 11 together, it can be seen that the strands 101 and 103 provide mechanical anti-delamination strength, by being separated into distinct planes, and also provide significant resistance to tearing regardless of the direction in which force is applied to the mat.

Referring to FIGS. 2–6 together, the structure which may be employed for laying the slivers or strands 101 and 103 into the mat has been illustrated. Strands 101 may be drawn from spools 111, passed between a pair of pinch-rollers 113, and into projection tubes 115. As shown in FIG. 2, the pinch rollers 113 may be driven by the same motor 117 utilized to power the chain-driven roller 37. Thus, the pinch-rollers draw a plurality of strands 101 from the spools 111 and each strand is passed through an individual projection or propulsion tube 115 for delivery to the mat building screen 35. Thus, the pinch-rollers 113 may be employed to accurately control the speed with which the strands 101 are pulled from the spools 111. In order to propel each strand 101 through its respective tube 115, each tube may be provided with an injection branch 119 through which water may be passed via a pipe 121 connected to the drain pan pipe 91 as illustrated in FIG. 1. Thus, by controlling the pressure of the water passed through the injection branch 119, the speed of the strand 101 through each pipe 115 may be controlled, causing the strand to be laid upon the mat building screen 35 in a substantially longitudinal orientation. As stated previously, this orientation may be in the form of a straight line or, preferably, in a sinusoidal configuration, dependent upon the speed of the rollers 113 and the injection pressure.

Preferably, the leading end of each projection or propulsion tube 115 should be located close enough to the screen to prevent any build-up of fiber or other miscellaneous materials in the slurry. This can be accomplished, for example, by moving all of the tubes 115 simultaneously by means of a pulley and winch assembly 121 (FIG. 2) acting upon a block 123 through which all of the tubes may be passed. The upper ends of all of the tubes may also be supported to pivot about a pin 125 by means of a block 127 located near one end of the slurry tank 33.

In order to project the randomly oriented slivers or yarns 103 into the mat, a plurality of projection or propulsion tubes 141 may be provided for passage of the strands 103 from spools 143. Thus, each strand 103 may be passed through its own projection tube 141. The speed of the strand through its projection tube may be governed by an injection branch 147. Branch 147 may receive water through a pipe 149 which may also be attached to the drain pipe line 91, as illustrated in FIG. 1.

Preferably, the speed of the strands 103 through their projection tubes 141 should be greater than the speed of the strands 101 since more strand material is required to provide the random orientation. Preferably, the leading ends of the projection tubes 141 may be located above the surface of the slurry bath. This will allow the strands 103 to assume a more random orientation within the mat as well as to prevent a build-up of fibers and other materials at the leading ends of the tubes. Of course, water passing through the tubes from the injection branches 147 will merely drop into the slurry for recirculation in the manner previously described.

Figure 7:
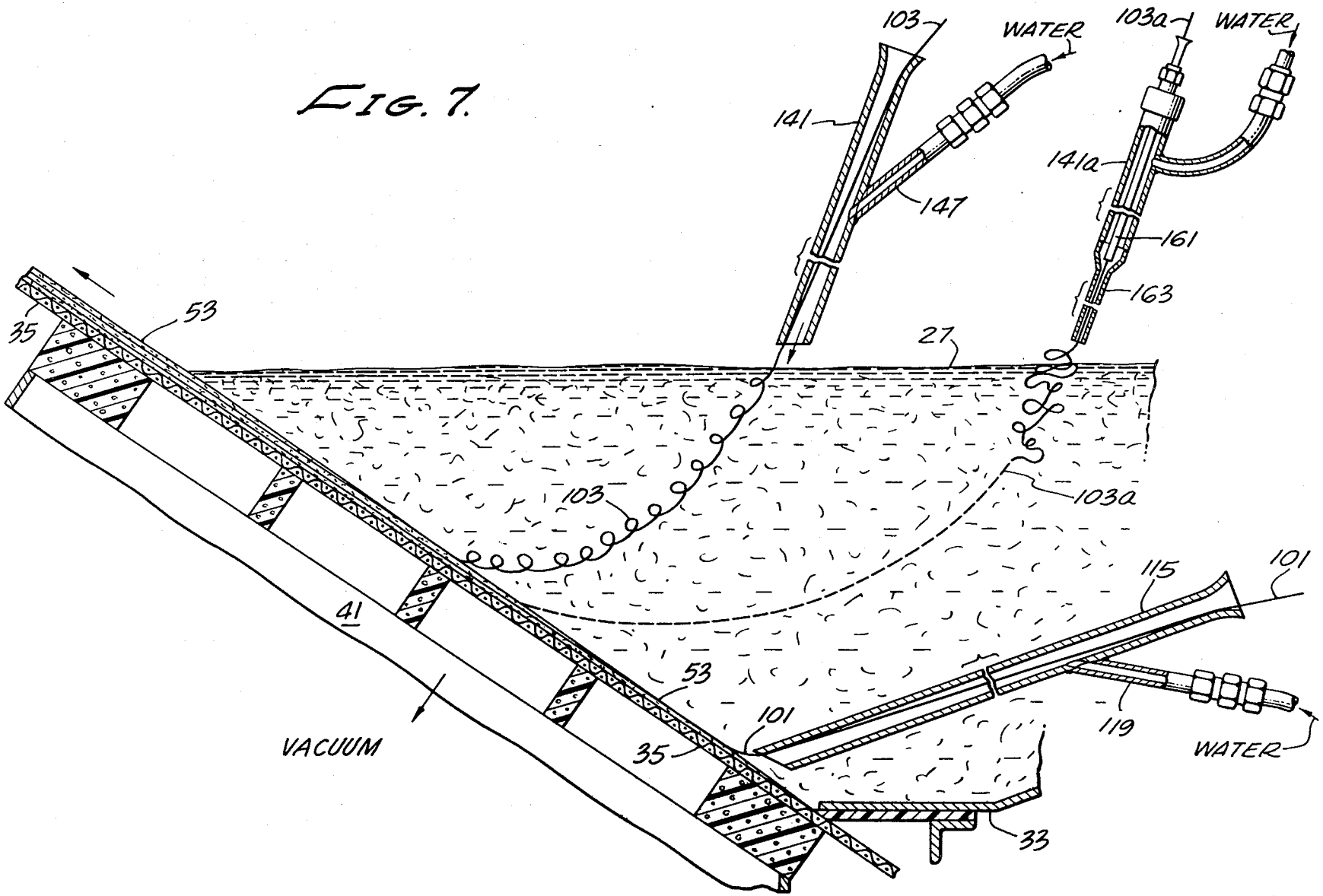
FIG. 7 comprises a view, similar to FIG. 6, of an alternate embodiment of the invention.
Figure 10:
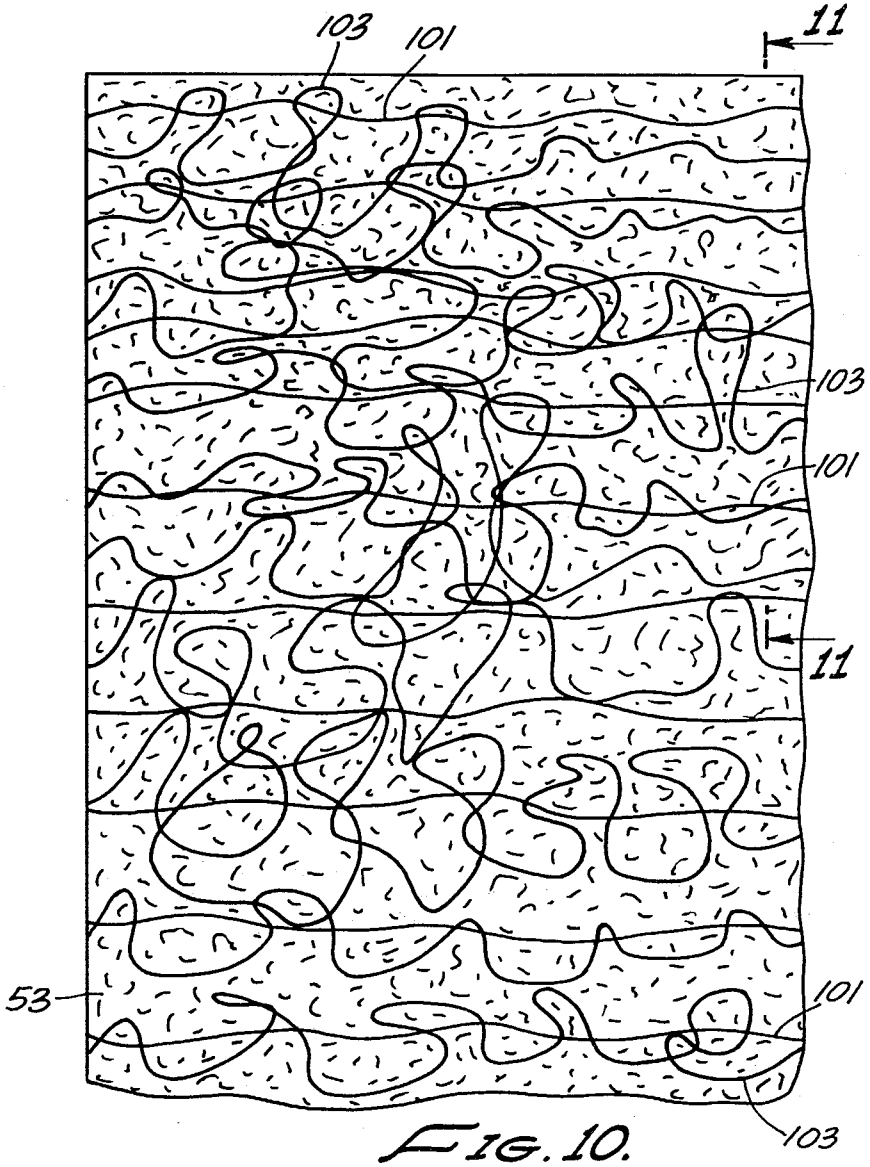
FIG. 10 comprises a top plan view of the mat, showing the combined reinforcing strands illustrated in FIGS. 8 and 9.

Referring now to FIG. 7, there is shown an alternate embodiment of the invention in which a projection tube 141*a* may be used either instead of or in addition to the projection tube 141. For example, if it is desired to provide more than a single planar level of randomly oriented strands in the mat, additional projection tubing of either the type shown at 141 or at 141*a* may be employed. Alternatively, the tubes 141*a* may be employed in place of the tubes 141 when providing a single planar level of randomly oriented strands. In any event, the tube 141*a* may be provided with an inner, substantially coaxially oriented tube 161 which terminates immediately above a neck portion or nozzle 163 of the projection tube 141*a*.

Water may be delivered under pressure to the reinjection branch 147*a* of each tube. As the water travels downwardly between the inner wall of tube 141*a* and the outer wall of tube 161, it will completely surround the inner tube 161. As it reaches the neck 163, a back-pressure will be created within the tube 141*a* which will greatly increase the velocity of the flow of water through the neck. Consequently, the increased back pressure will increase the velocity of movement of the strand 103. Use of this generally concentric tubing arrangement allows the water pressure to completely surround the strand so as to pull it out of the tube 161 in a more uniform fashion. In other words, it will be impossible for the water pressure to act primarily against one side of the strand 103*a*. Such an uneven application could cause intermittent bunching and release of the strand, with a resultant nonuniformity of distribution in the mat.

Thus, a machine formed in accordance with the above description will allow a build-up of chopped glass fiber in accordance with the distance that the mat forming screen 35 must travel to pass through the slurry 27. Also, the longitudinally oriented strands and the randomly oriented strands may be applied to the matting at different locations within the slurry in such a manner that none of the strands are exposed at the top or bottom surfaces of the mat. Additionally, the mat will be provided with sufficient mechanical strength between the strand planes to prevent laminar separation.

Consequently, the employment of this novel method of forming a mat through the use of structure such as that depicted here will allow those skilled in the art to produce a vastly improved fiberglass mat structure in high production quantities. However, those skilled in the art will realize that the method and apparatus described above may be employed for a wide variety of products and with a wide variety of machines without exceeding the scope of the invention as defined in the following claims.

I claim:

1. The method of making a wet process fiber mat comprising the steps of:

a. forming an aqueous body of chopped fiber slurry;

b. moving an endless screen upwardly through said slurry from an entrance position spaced substantially below said slurry surface and at a predetermined rate of movement to an exit position at the surface of said slurry;

c. applying suction to the lower surface of said screen, in a zone through which said screen moves in order to draw water of said slurry through said screen thereby;

d. collecting a first layer of chopped fibers on the surface of the screen with increasing thickness as the distance traveled by the screen through the slurry increases;

e. positioning a first reinforcement strand projecting means beneath the surface of the slurry;

f. projecting a plurality of first continuous reinforcement strands through said first strand projecting means below the slurry surface by propelling said first strands at approximately the same velocity as said screen onto said first chopped fiber layer at a first predetermined location intermediate the ends of the screen thereby depositing said first reinforcement strands in a longitudinally oriented configuration and in a first substantially horizontal plane within the resultant mat;

g. collecting a second layer of chopped fibers on top of said first layer and said first reinforcement strands with increasing thickness as the distance traveled by the screen through the slurry increases;

h. positioning a second reinforcement strand projecting means above the surface of said slurry at a location between the first projecting means and the exit position;

i. projecting a plurality of second continuous reinforcement strands onto the surface of said slurry by projecting said second strands from said second strand projecting means from above the slurry surface onto that slurry surface near said exit position at a velocity greater than the velocity of said screen such that the second strands assume a randomly oriented interengaged configuration upon entering said slurry;

j. allowing said random interengaged strands to migrate in an unconstrained manner from the slurry surface through the slurry and onto said second chopped fiber layer captured by the screen at a second predetermined location intermediate the ends of said screen thereby depositing said second reinforcement strands in a substantially horizontal plane within the resultant mat so that both random and longitudinal reinforcement strands will be present in the resultant mat;

k. continuing the movement of the screen past the point of randomly oriented strand installation to cover said strands with a third uniform layer of chopped fibers; and l. moving the screen out of the slurry, thus withdrawing the wet mat from the slurry.

2. The method of claim 1 which also includes the steps of:

a. controlling the velocity at which said reinforcement strands enter said projection means by drawing said strands through speed control means; and b. further controlling the velocity of said reinforcement strands by controlling pressure of propellant in said projection means and thereby controlling the velocity of said reinforcement strands.

3. The method of claim 2 wherein the first recited strands are projected at a rate sufficient to provide a substantially straight configuration in the resultant mat.

4. The method of claim 2 wherein the first mentioned strands are projected at a rate sufficient to provide a generally sinusoidal configuration which deviates from a straight line by not less than $\pm\frac{1}{4}$ inch and by not more than $\pm\frac{3}{4}$ inch.

5. The method of making a non-woven fiber mat comprising the steps of:

a. mixing chopped glass fibers with water to form a slurry;

b. moving an endless screen within said slurry in a position spaced a distance substantially below said slurry surface and at a predetermined rate of of movement;

c. applying suction to the lower surface of said screen, in a zone through which said screen moves in order to draw water of said slurry through said screen thereby collecting a first layer of said fibers on the surface thereof with increasing thickness as the distance traveled by the screen through the slurry increases;

d. projecting a plurality of continuous reinforcement strands through elongated tubes extending below the slurry surface by employing a fluid propellant to propel said strands onto said first layer of chopped fibers at a predetermined location intermediate the ends of the screen travel through the slurry;

e. controlling the velocity at which said strands enter said slurry by drawing said strands through braking means such that said strands' velocity is substantially the same as the velocity of said screen;

f. controlling the pressure of said propellant in said tubes and thereby controlling said strands' velocity such that said strands assume a generally longitudinal configuration within a predetermined single horizontal plane within the resultant mat;

g. continuing the movement of the screen past the point of longitudinal strand installation to cover said strands with a uniform second layer of chopped fibers;

h. projecting a plurality of continuous reinforcement strands onto the surface of said slurry by employing a fluid propellant to project said strands through elongated tubes positioned above the slurry surface at a velocity such that the strands assume a randomly oriented interengaged configuration upon entering said slurry;

i. allowing said randomly interengaged strands to be carried through the slurry and onto the second chopped fiber layer captured by the screen at a predetermined location intermediate the ends of said screen and thereby being deposited in a single horizontal plane within the forming mat;

j. continuing the movement of the screen past the point of randomly oriented strand installation to cover the randomly oriented interengaged strands with a uniform third layer of chopped fibers; and k. moving the screen out of the slurry thus withdrawing the mat from the slurry.

6. Apparatus for forming a non-woven mat including means for forming a slurry of substantially uniformly dispersed glass fiber means for separating the fibers from the slurry in a uniformly increasing thickness as said separating means is moved through the slurry, the thickness being dependent upon the distance and the rate of travel of said separating means through said slurry means for moving said separating means through and out of the slurry in a gradually rising movement; the improvement comprising:

a. strand projection means positioned above the surface of said slurry for directing fluid propellant therethrough to project a plurality of continuous fiber strands onto the surface of said slurry at a predetermined location intermediate the travel extremities of said separating means through the slurry such that said strands will be carried through the slurry and onto said separating means;

b. means for controlling the fluid pressure of said propellant in such strand projection means thereby controlling the velocity at which said strands are projected onto the slurry surface, to project said strands onto said slurry surface at a velocity greater than the speed of said separating means such that said strands upon being carried through the slurry and deposited on said separating means assume a randomly oriented interengaged configuration in a predetermined single substantially horizontal plane within the resultant mat;

c. strand projection means positioned beneath the surface of said slurry for directing fluid propellant therethrough to project a plurality of continuous fiber strands onto the surface of the separated fibers at a predetermined location intermediate the travel extremities of said separating means; and d. means for controlling the fluid pressure of the last mentioned propellant in such strand projection means thereby controlling the velocity at which said strands are projected into the slurry to project said last mentioned strands into said slurry at a velocity approximately equal to the velocity of said separating means such that said last mentioned strands are deposited on said separating means in a longitudinally arranged configuration in a predetermined single substantially horizontal plane within the resultant mat.

7. The apparatus of claim 6 wherein:

a. said last mentioned fluid pressure controlling means is adjustable to adjust the pressure therein to project said strands at a rate sufficient to cause the strands to form a generally straight configuration.

8. The apparatus of claim 6 wherein:

a. said last mentioned fluid pressure controlling means is adjustable to adjust the pressure therein to project said last mentioned strands at a rate sufficient to cause the last mentioned strands to form a generally sinusoidal oriented configuration in a single predetermined substantially horizontal plane within the resultant mat.

9. The apparatus of claim 6 wherein:

a. said projection means include means for generating a fluid back pressure therein to increase the strand projection rate therefrom and means for causing fluid pressure therein to be imposed upon the entire periphery of a reinforcement strand.

10. Apparatus for forming a non-woven mat including means for forming a slurry of substantially uniformly dispersed glass fiber means for separating the fibers from the slurry in a uniformly increasing thickness as said spearating means is moved through the slurry, the thickness being dependent upon the distance and the rate of travel of said separating means through said slurry means for moving said separating means through and out of the slurry in a gradually rising movement; the improvement comprising:

a. strand projection means for directing fluid propellant therethrough to project a plurality of continuous reinforcing strands against said chopped fibers deposited on said separating means at an essentially horizontal planar location within the slurry at a predetermined location intermediate the travel extremities of said separating means through the slurry, said projection means extending downwardly through said slurry to a position near the surface of said separating means, to project said strands toward said separating means;

b. means for controlling the velocity at which said strands enter said projection means such that said strands velocity is substantially the same as the velocity of said separating means;

c. means for controlling the fluid pressure of said propellant in said strand projection means thereby further controlling the velocity of said strands such that said strands can be made to assume a generally longitudinal configuration within a predetermined single essentially horizontal plane in the resultant mat;

d. additional strand projection means positioned above the surface of said slurry for directing fluid propellant therethrough to project a plurality of continuous reinforcing strands onto the surface of said slurry at a predetermined location intermediate the travel extremities of said separating means through the slurry;

e. means for controlling the fluid pressure of said propellant in said additional strand projection means thereby controlling the velocity of said strands to project strands onto said slurry surface at a velocity greater than the speed of said separating means such that said last mentioned strands upon being deposited on said separating means assume a randomly oriented interengaged configuration in a single essentially horizontal plane within the resultant mat.

11. The apparatus of claim 10 wherein:

a. said projection means include, means for varying the location intermediate the ends of screen travel at which projected strands are introduced into the forming mat.

12. The method of claim 1 wherein said reinforcement strands are projected by employing a fluid propellant and elongated projection tubes.

13. The method of claim 1 wherein said second predetermined location is upstream of said first predetermined location.

14. The method of claim 1 further including resisting the projection of said reinforcement strands onto said mat.

* * * * *